US008863679B2

(12) United States Patent
Nagel et al.

(10) Patent No.: US 8,863,679 B2
(45) Date of Patent: Oct. 21, 2014

(54) LINKAGE DEVICE FOR FLAP RUDDERS FOR WATERCRAFT

(75) Inventors: Manfred Nagel, Henstedt-Ulzburg (DE); Jorg Hiesener, Hamburg (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 0 days.

(21) Appl. No.: 12/846,090

(22) Filed: Jul. 29, 2010

(65) Prior Publication Data

US 2011/0023764 A1 Feb. 3, 2011

(30) Foreign Application Priority Data

Jul. 31, 2009 (DE) ..... 20 2009 010 424 U

(51) Int. Cl.
*B63H 25/06* (2006.01)
*B63H 25/38* (2006.01)

(52) U.S. Cl.
CPC ..... *B63H 25/381* (2013.01)
USPC ..... 114/162

(58) Field of Classification Search
USPC ..... 114/162–172
See application file for complete search history.

(56) References Cited

U.S. PATENT DOCUMENTS

| | | | | |
|---|---|---|---|---|
| 1,100,349 | A | 6/1914 | Brennan | |
| 4,448,146 | A * | 5/1984 | Becker | 114/162 |
| 5,829,887 | A | 11/1998 | Strong et al. | |
| 6,945,186 | B2 * | 9/2005 | Lehmann | 114/162 |
| 2005/0000402 | A1 | 1/2005 | Lehmann | |

FOREIGN PATENT DOCUMENTS

| | | | |
|---|---|---|---|
| DE | 2353934 | A1 | 7/1974 |
| DE | 29609745 | U1 | 8/1996 |
| DE | 201 18 779 | U1 | 2/2002 |
| EP | 0 811 552 | A1 | 12/1997 |
| EP | 0811552 | A1 | 12/1997 |
| EP | 1391380 | A1 | 2/2004 |
| JP | 52-049158 | A | 4/1977 |
| JP | 54-041099 | A | 3/1979 |
| JP | 10-053196 | A | 2/1998 |
| JP | 2005-509561 | A | 4/2005 |
| KR | 1020050039743 | A | 4/2005 |
| WO | 2009-012305 | A2 | 1/2009 |

OTHER PUBLICATIONS

"Thordon bearings", World Fishing, Aug. 1992, p. 31, 2nd column, 5th paragraph and 2nd column, last paragraph.

Robert Bosch "Kraftfahrtechnisches Taschenbuch", Vieweg, Braunschweig, Wiesbaden, 1999, pp. 286-287, chapters: dry sliding bearings, full polymer bearings, composite bearing, metal-ceramic bearings.

* cited by examiner

*Primary Examiner* — Daniel V Venne
(74) *Attorney, Agent, or Firm* — Kelly & Kelley, LLP

(57) ABSTRACT

In a linkage device for flap rudders for watercraft, in particular ships, a first bearing housing includes a sliding piston and a first sliding bearing, and a second bearing housing includes a linkage pin and optionally a second sliding bearing. The first and the second bearing housings and/or the sliding piston and the linkage pin and/or optionally the first and the second bearings each have substantially the same diameter and/or substantially the same width and height.

8 Claims, 2 Drawing Sheets

LINKAGE DEVICE FOR FLAP RUDDERS FOR WATERCRAFT

The invention relates to a linkage device for flap rudders for watercraft, in particular ships, comprising a first bearing housing in which a sliding piston and a first bearing, in particular a sliding bearing are located and a second bearing housing in which a linkage pin and optionally a second bearing, in particular a sliding bearing, are located.

Rudders with fins or flaps are also designated as "flap rudders". These mostly comprise so-called full spade rudders or heel-supported rudders, having a movable or pivotable (rudder) flap fastened to the rudder blade end strip thereof by means of suitable fastening means, for example, articulated connections such as hinges or similar. The flap is normally configured to be articulated to the rudder blade of the rudder, wherein the deflection of the flap can be predefined by means of an articulation device arranged between hull and flap. Such rudders are frequently configured to be forcibly controlled so that when setting the rudder, i.e. when pivoting the rudder about the axis of rotation of the rudder, the flap is likewise deflected. By this means a larger deflection of the propeller jet and higher rudder forces can be achieved with flap rudders so that an improved manoeuvrability is obtained compared with rudders without flaps. The flap should therefore be swivellably connected to the (main) rudder blade of the rudder and is normally pivotable about a vertical axis or about an axis parallel to the end strip of the rudder blade in the built-in state. The articulation device according to the invention is used for the articulation of a flap of a flap rudder and can be used in principle in all known types of rudders, but preferably in full spade rudders or in heel-supported rudders mounted in the stern.

In principle the present invention can be used for all types of rudders, wherein the articulation device according to the invention is predominantly suitable for rudders in ships in the commercial or military area. These include both ocean-going vessels and inland navigation vessels. The articulation device according to the invention can be used particularly advantageously for deployment in small and medium-sized ships as well as rather slower commercial or military ships, for example, at a maximum speed of 20 knots, preferably 18 knots, particularly preferably 15 knots.

The articulation or adjusting device configured for the forced control or articulation of the flap of a flap rudder is normally fastened both to the flap blade or to the flap and also to the hull. By means of the articulation device, a rotation of the main rudder blade effects an additional rotation of the flap rudder blade at the rear edge of the main rudder blade relative to the main rudder, which is in the same direction and normally of approximately the same amount, thus increasing the transverse forces produced by the rudder.

EP 0 811 552 A1 discloses a known articulation device which comprises a first bearing housing in which a sliding piston is mounted by means of a sliding bearing. The bearing housing is firmly connected to the flap on its upper side. Since the sliding piston or sliding pivoting piston in an installed rudder is frequently aligned approximately horizontally, such pistons are also known as horizontal pistons. Furthermore, the known articulation device has a second bearing housing in which a linkage pin or bolt is mounted by means of a second sliding bearing. The second bearing housing is firmly connected to the hull. In principle, however, the linkage pin could also be firmly clamped in the axial direction so that the second sliding bearing would be omitted. Such a linkage device ensures secure forced articulation of the rudder flap when setting the main rudder. At the same time, by mounting the sliding piston in a sliding bearing and optionally the linkage pin in a second sliding bearing, extensive degrees of freedom are created for the articulation device with the result that the bearing surfaces are subjected to relatively little loading. The connection between sliding piston and linkage pin can be designed in many ways. In the articulation device disclosed in EP 0 811 552 A1, the connection is made by means of a hinge bolt in the manner of a Cardan joint which allows a movement (in the angular position) between sliding piston and linkage pin whereby bending moments acting on the rudder can be compensated.

Since different forces of different intensity act on the system of the sliding piston and the system of the linkage pin, in the articulation devices known from the prior art the two aforesaid systems are differently configured in regard to their dimensions or sizes as well as optionally choice of material. As a result, on the one hand in cases in which the maximum loads calculated or assumed for the sliding piston or the linkage pin are reached or exceeded in operation, this can result in damage to the articulation device. On the other hand, the design and production of the articulation devices becomes relatively expensive as a result.

It is therefore an object of the present invention to provide a linkage device for flap rudders for watercraft, in particular ships, which has an increased safety towards high loads and a simple structure. This object is achieved with a linkage device having the features of claim 1.

According to this, a linkage device of the type specified initially is configured in such a manner that the first and the second bearing housing and/or the sliding piston and the linkage pin and/or optionally the first and the second bearing each have substantially the same diameter and/or substantially the same width and height. Since respectively one component pair of the two systems "sliding piston" and "linkage pin" of the articulation device is configured to be the same with regard to its dimensions, it is achieved that the entire articulation device is designed according to the maximum load which prevails in one of the two systems sliding piston and linkage pin, and consequently the safety overall is increased. A system in each case comprises a piston (sliding piston or linkage pin), a bearing housing and optionally a bearing. Normally the sliding piston system has the highest loads. Consequently, the system or at least a component of the linkage pin system is automatically designed or dimensioned precisely as in the sliding piston system so that an increased safety is achieved compared with arrangements known from the prior art. Furthermore, by using the same components in both systems the storage or manufacture of the articulation device is simplified and consequently production costs are also reduced. Since normally both bearing housing and also sliding piston or linkage pin and bearing are configured to be cylindrical or as cylindrical hollow bodies, the component pairs normally have the same diameter. Width and height should only be configured to be the same in the case of differently configured components or components having a different cross-sectional area. Preferably two component pairs and particularly preferably all three component pairs of the two systems, linkage pin and sliding piston, are configured to be the same with regard to the said dimensions so that on the one hand safety is maximised and on the other hand manufacture or storage is simplified.

In the case of cylindrical hollow bodies such as, for example, the bearings or the bearing housing can be, both the inside diameter and also the outside diameter can each be configured to be the same. Preferably both inside and outside diameter of one component pair, preferably of the first and second bearing housing, are each configured to be the same.

By providing component pairs of the same diameter or the same width and height, for the production of a component pair only a single base component needs to be provided or stored and merely adapted with regard to its length for the respectively required system.

Normally the bearing housing is configured as a cylindrical hollow body inside which there is provided a sliding bearing configured as a cylindrical bearing bush. Optionally the bearing housing and the sliding bearing can possibly be designed as one component, wherein this component should then be configured to be the same as the corresponding component of the other articulation device system in regard to its diameter.

In a preferred embodiment the first and the second bearing housing and/or the sliding piston and the linkage pin and/or optionally the first and the second bearing each consist of the same material. Since those component pairs which have the same dimensions, i.e. substantially the same diameter and/or substantially the same width and height, also consist of the same material, the two individual components of a component pair are worked from or made from the same base material or the same base component or workpiece. If, for example, the sliding piston and the linkage pin, which both together form a component pair, have the same dimensions and are configured to consist of the same material, it is expedient to dimension at least the first and the second bearing, if present, to be the same and form them from the same material since the bearings must necessarily be adjusted to the dimensions of the sliding piston or the linkage pin. Particularly preferably the bearing housing is additionally also the same and configured to consist of the same material. In this case, the articulation device or at least the essential parts of the articulation device can be made of three base materials or workpieces since each of the three component pairs of the articulation device (sliding piston and linkage pin; first and second bearing housing; first and second bearing) is each made of one base material. By this means the costs of storage and manufacture are significantly reduced and the manufacturing process per se is accelerated.

If sliding piston and linkage pin are substantially provided with the same diameter, it is further preferred that the size of the diameter is determined or designed with reference to the loads acting on the sliding piston during operation. Usually larger loads act on the sliding piston during operation compared with those on the linkage pin. It is therefore expedient to design the maximum load bearing capacity of the sliding piston and of the linkage pin for the forces acting on the sliding piston. By this means the safety of the articulation device is improved insofar as the linkage pin is now designed in relation to its dimensions for the larger forces acting on the sliding piston. Accordingly, the components at the bearings or at the bearing housings should also be measured with reference to the loads on the sliding piston side.

The first and second bearings configured in particular as sliding bearings are expediently configured as bearing bushes, i.e. as cylindrical hollow bodies which are to be inserted in the bearing housing. The inside diameter of the bearing housing which is advantageously also configured to be cylindrical or as a cylindrical hollow body preferably approximately corresponds to the outside diameter of the corresponding bearing. Depending on the type of fastening, the aforesaid diameters can also differ slightly from one another (e.g. during shrinking or thermal expansion (freezing)). The inside diameter of the bearing housing can also be smaller if, for example, a suitable recess for the larger outside diameter of the bearing is provided in the inner surface of the bearing housing. It is expedient to use bearing bushes for the design of bearings or sliding bearings since bearing bushes can be easily and inexpensively manufactured from common components such as tubes.

In particular, it is preferable if the first and/or the second bearing are configured as solid friction bearings. Such bearings are also called "self-lubricating bearings" since one of the mounting partners has self-lubricating properties. These bearings manage without additional lubrication or lubricants since grease lubricants are embedded in the material they are made from and these reach the surface due to microwear during operation, and thus friction and wear of the bearings is reduced. In particular, plastics or plastic composites and/or ceramic building materials are used to form these bearings. An example of such materials is PTFE (polytetrafluoroethylene). On the one hand, the structure and the maintenance of the articulation device is further simplified by using such self-lubricating bearings. On the other hand, sliding bearings made of materials of this type are frequently available on the market in the form of a cylindrical hollow body or a tube having a specific length. In this respect, both a first and a second bearing can be simply created within the framework of the present invention by simply cutting suitable bearing bushes to the length required in each case.

Furthermore, the object forming the basis of the invention is achieved by a linkage device kit for producing a linkage device for flap rudders for watercraft, in particular ships, comprising a cylindrical solid body, in particular a round steel body, a hollow body, in particular a tube, a cylindrical hollow bearing body, in particular a tube, and optionally a connection means for connecting two pieces of the cylindrical solid body. The cylindrical hollow bearing body is configured for mounting at least one piece of the cylindrical solid body. The term "cylindrical solid body" covers all cylindrical bodies which have a solid cross-section, i.e. are not hollow. A sliding piston or a linkage pin can be simply created from the cylindrical solid body by separating or cutting off two pieces. Furthermore, a first and a second bearing housing can be created by separating two pieces from the hollow body. The bearing body is configured for mounting or supporting at least a piece of the cylindrical solid body (sliding piston). Either the entire bearing body can be used for mounting or a piece can be separated. If the linkage pin is mounted (displaceably along its longitudinal axis), a further piece is expediently separated. The solid, the hollow body and the bearing body thus form the base or starting materials from which a linkage device according to the invention can be created. In principle, the kit can be of a complete nature so that no further additional components or material are added for the manufacture of the articulation device. However, the provision of further additional components to the articulation device is readily possible. Thus, for example, the kit can comprise optionally suitable connection means for connecting the two solid body pieces.

Preferably the outside diameter of the bearing body is the same as or slightly larger than the inside diameter of the hollow body. Consequently, the hollow body can either be formed in an exactly fitting manner for insertion in the bearing body or, for example, when fastening the bearing body in the hollow body by means of thermal expansion, it can be slightly larger. Furthermore, the outside diameter of the hollow body preferably approximately corresponds to the inside diameter of the bearing body so that the former can be inserted in an exactly fitting manner into the latter. In particular, in a bearing body configured as a self-lubricating bearing, in which no additional lubricating film need be provided between bearing body and solid body, the same configuration of the two aforesaid diameters is expedient. Finally, the wall thickness of the hollow body should expediently be selected to be greater than that of the bearing body since the hollow body is provided for forming a bearing housing.

Furthermore, the object forming the basis of the invention is achieved by a method for producing a linkage device for flap rudders for watercraft, in particular ships, comprising a first bearing housing in which a sliding piston and a first bearing, in particular a sliding bearing, are arranged and a second bearing housing in which a linkage pin and optionally a second bearing, in particular a sliding bearing are arranged, wherein in order to produce the sliding piston and the linkage pin, two pieces are separated from a cylindrical solid body, in particular a round steel body, wherein in order to produce a first and optionally a second bearing at least one piece is separated from a cylindrical, hollow bearing body, in particular a tube, wherein in order to produce a first and a second bearing housing, two pieces are separated from a hollow body, in particular a tube, wherein the bearing body pieces or the bearing body piece are each inserted into a hollow body piece and fastened there, wherein the solid body pieces are each inserted into a bearing body piece or a hollow body piece and thereby arranged in such a manner that in each case at least one end region of a solid body piece protrudes from that bearing body piece or hollow body piece into which it is inserted and wherein the two solid body pieces are connected to one another in their at least one end regions.

In the method according to the invention, in each case at least one or two pieces are therefore separated, for example, by cutting from a cylindrical solid body, a bearing body and a hollow body. The aforesaid components preferably comprise parts made of metal or steel. The aforesaid components can be dimensioned so that they have such a length that in each case only two pieces need to be cut out or separated without leaving a remainder. Optionally, however they can also have such a length that an offcut remains that could be used again, for example, for producing another articulation device. Thus, for example, two pieces could be separated from two different cylindrical solid bodys or similar, but which are identical in regard to their dimensioning or their diameter and their material and assembled together in a linkage device. The bearing body piece or the pieces of the bearing body are each inserted into a piece of the hollow body and fastened there. Consequently, the hollow body piece forms the housing and the bearing body piece arranged in the same forms a bearing or sliding bearing. The solid body pieces forming the sliding piston or the linkage pin are then inserted into the bearing body piece or into a hollow body piece and thereby arranged in such a manner that respectively one end region of the solid body piece protrudes or projects from the bearing body piece or hollow body piece since the fastening of the two hollow body pieces or the sliding piston and the linkage pin in the two protruding end regions must be accomplished in an expedient manner. Appropriate connection means, for example, swivel pins or the like can be used for the connecting.

Furthermore, a recess in which the bearing body piece can be received can be formed in the inner side of the hollow body piece for fastening a bearing body piece in a hollow body piece. Alternatively or additionally the bearing body piece can advantageously be fastened in the hollow body piece by means of thermal expansion. With these embodiments, a stable fastening between bearing body piece and hollow body piece can be achieved in a simple manner without providing additional connection or fastening means.

Furthermore, the object forming the basis of the invention can be achieved by using a cylindrical solid body, in particular a round steel body, a hollow body, in particular a tube, and a cylindrical hollow bearing body, in particular a tube, for producing a linkage device for flap rudders for watercraft, in particular ships. The bearing body is configured for mounting at least one piece of the cylindrical solid body.

The articulation device according to the invention is explained in further detail by an exemplary embodiment shown in the drawing. Shown schematically in the figures.

Figure 1:
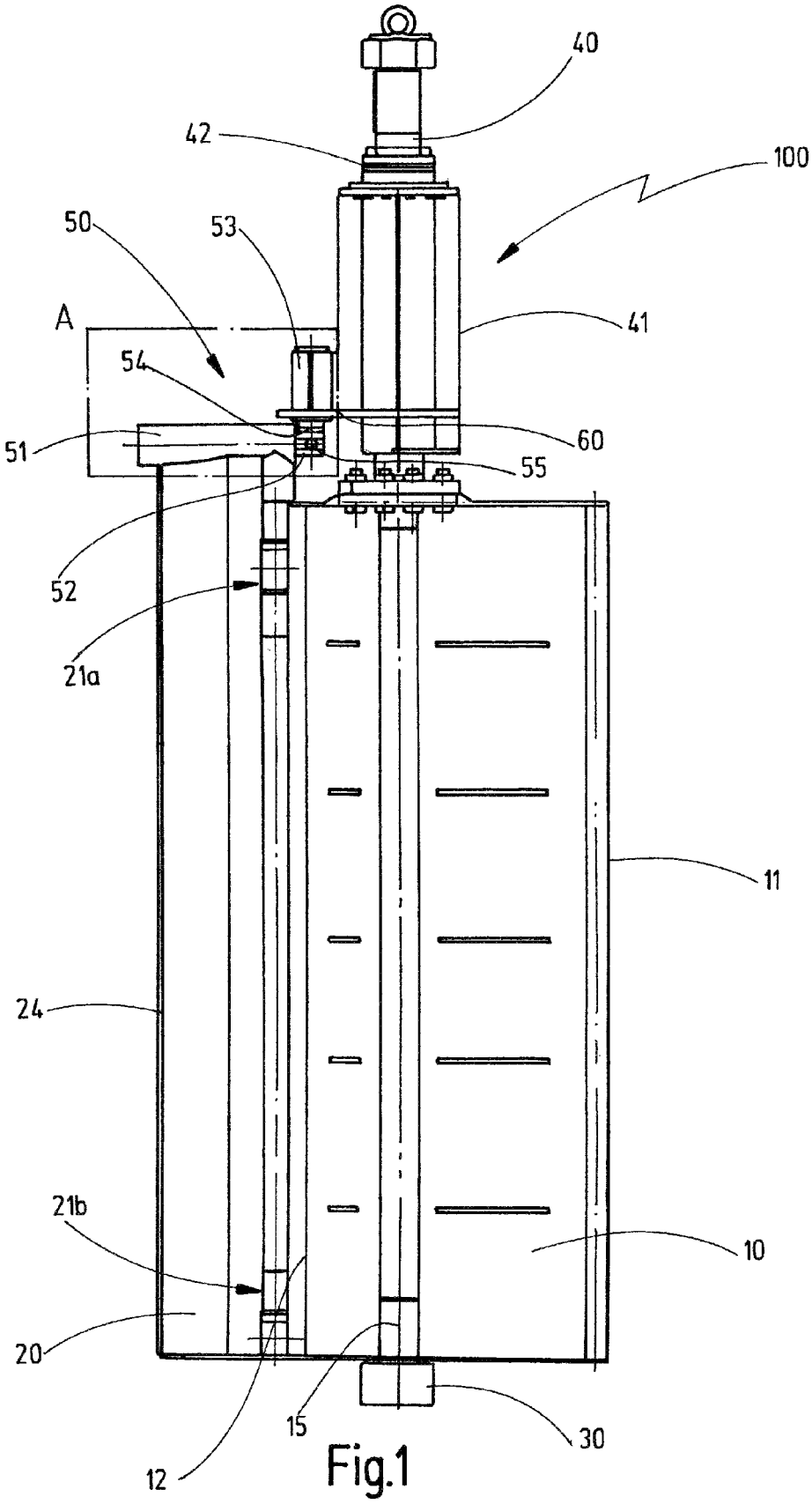
FIG. 1 shows a side view of a flap rudder with a linkage device.

FIG. 1 shows a side view of a rudder 100 according to the invention which comprises a rudder blade 10 and a force-controlled flap 20 mounted in an articulated manner on the rudder blade 10. The rudder type shown in FIG. 1 is a so-called "heel-supported rudder" which is mounted both in the upper and in the lower rudder region. On the lower side the rudder 100 has a pintle 30 for mounting in the stern of a ship (not shown here). In the upper region on the other hand, there is provided a rudder post 40 which extends along the rudder axis of rotation 15 and the rudder 100 is rotatable around the rudder. The rudder post 40 is firmly connected to the rudder blade 10. Furthermore, the rudder post 40 for supporting the rudder is mounted on the hull (not shown here) in the region of the cladding 41 and by means of a journal bearing 42. The rudder blade 10 has a leading edge 11 facing a propeller of a ship (not shown here) in the built-in state and a rear rudder blade trailing edge 12 facing the flap 20. The flap rudder 100 comprises two articulated connections 21*a*, 21*b* by which means the flap 20 is fastened in an articulated manner on the rudder blade 10 in the region of the rudder blade trailing edge 12. The flap 20 is configured swivellably on the rudder blade 10 by means of said articulated connection 21*a*, 21*b*. Furthermore, the flap 20 has a flap trailing edge 24. The longitudinal axis of the flap 20 is disposed approximately parallel to the longitudinal axis of the rudder blade 10 and to the rudder axis of rotation 15. Furthermore, the flap 20 projects by a relatively short amount beyond the rudder blade 10 in the upper region and ends flush with the rudder blade 10 in the lower region.

The flap rudder 100 further has a linkage device 50 for linkage of the flap 20 to the rudder blade 10. The articulation device 50 is formed by a first bearing housing 51 which is arranged horizontally and connected to the flap 20 on the upper side thereof, a sliding piston/horizontal piston 52 arranged in said first bearing housing 51, a second bearing housing 53 which is arranged vertically and connected to the hull (not shown here) and a linkage pin/vertical piston 54 arranged in said second bearing housing 53. For fastening the second bearing housing 53 on the hull there is provided a holding frame 60 which is configured as a horizontally aligned plate and is firmly connected to the second bearing housing 53 by means of welding. The first bearing housing 51 is also connected to the flap 20 by means of welding. Both bearing housings 51, 53 are formed by cylindrical hollow bodies (tubes) whilst the two pistons 52, 54 consist of cylindrical solid bodys which, in the undeflected state shown in FIG. 1, each project with an end region 521, 541 from the bearing housing 51, 53. The two end regions 521, 541 standing substantially orthogonally to each other are interconnected by means of a hinge bolt 55. The hinge bolt 55 ensures that a deviation from the 90° position caused by bending moments or the like acting on the flap 20 can be compensated.

Figure 2:
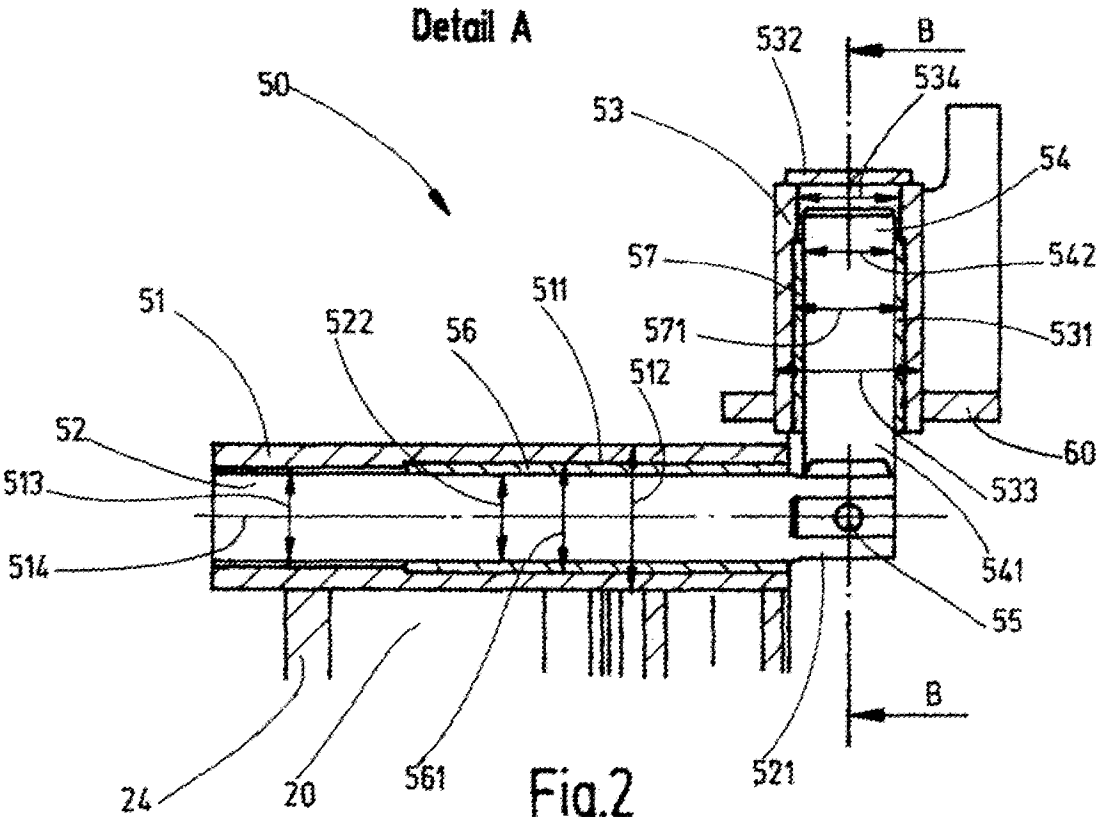
FIG. 2 shows a cutaway detail view of the articulation device from FIG. 1

A detail A indicated in FIG. 1 is shown in an enlarged view in FIG. 2 and shows the articulation device 50 from FIG. 1 in a sectional view. In the detail A it can be seen that from their edge region from which the piston end regions 521, 541 project from the housings 51, 53 as far as a rear region in their inner surface, both bearing housings 51, 53 have a peripheral recess or indentation 511, 531. A sliding bearing formed by a bearing bush is inserted in each of these recesses (511, 531), the first bearing being provided with the reference number 56 and the second bearing being provided with the reference number 57. The bearing bushes 56 and 57 can be fastened in the recesses 511, 531 of the first or second bearing housing 51, 53, for example, by means of thermal expansion. Both bearing bushes 56, 57 end with their end facing the hinge bolt 55 flush with the respective bearing housing 51, 53. The bearing bushes 56, 57 can be made, for example, from a self-lubricating plastic material. However, an embodiment made of metal, for example bronze, is possible, wherein a lubricating film should then usually be provided between pistons 52, 54 and bearing bush 56, 57.

The sliding piston 52 is slidable along the longitudinal axis 514 of the first bearing housing 51. The linkage pin 54 is likewise slidable along the longitudinal axis 535 of the second bearing housing 53 and is also rotatable around said axis. During a rotation of the rudder 100, i.e., when setting the rudder, the linkage pin 54 turns about the longitudinal axis 535 in the fixed second bearing housing 53 connected to the hull. Furthermore, the sliding piston 52 fastened to the linkage pin 54 by means of the hinge bolt 55 slides inside the first bearing housing 51, whereby the flap 20 is deflected with respect to the rudder blade 10. Fundamentally, however, it would also be possible for the linkage pin 54 to be fixed in the longitudinal direction 531 and only arranged rotatably about the longitudinal axis 535. The second bearing housing 53 has a cover plate 532 in its upper region whilst the first bearing housing 51 is open at both ends.

The sliding piston 52 formed as a cylindrical solid body has a diameter 522 which corresponds to the diameter 542 of the linkage pin 54. The first bearing bush 56 has an outside diameter 561 which corresponds to the outside diameter 571 of the second bearing bush 57. The inside diameters of the two bearing bushes 56, 57 also correspond with each other and correspond approximately to the diameters 522, 542 of the two pistons 52, 54. Finally, the outside diameter 512 of the first bearing housing 51 configured as a cylindrical hollow body corresponds to the outside diameter 533 of the second bearing housing 53 also configured as a cylindrical hollow body. The inside diameters 513, 534 of the first and second bearing housing 51, 53 also correspond with each other. Consequently, both the sliding piston 52 and the linkage pin 54 can be made from one workpiece, for example a round steel. In order that both the two bearing housings 51, 53 and the two bearings 56, 57 can each be made from one workpiece or from one tube, the wall thicknesses of the two bearing housings 51, 53 or the two bearings 56, 57 are also configured to be the same. The thickness of the recesses 511, 531 is also configured to be the same in the two bearing housings 51, 53. Only the length of the recesses 511, 531 differs from one another in relation to the housing longitudinal axes 514, 535. Likewise, the two bearing bushes 56, 57 and the two tubular bearing housings 51, 53 can each be made of a common workpiece which is in each case merely cut to length. By this means the manufacturing expense of the articulation device 50 is significantly reduced and at the same time the safety with respect to external loads is increased.

Figure 3:
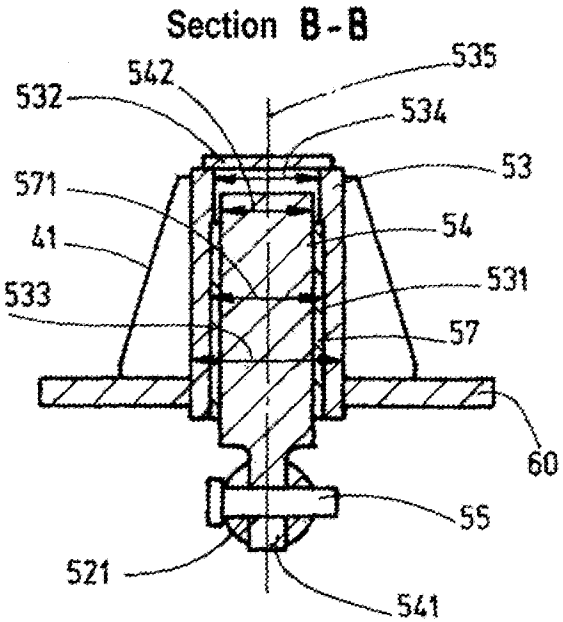
FIG. 3 shows a sectional view along the section B-B from FIG. 2.

FIG. 3 shows a sectional view along the section B-B from FIG. 2 through the linkage pin 54. Here it can be seen that the free end region 541 of the linkage pin 54 is configured as a web protruding approximately centrally from the linkage pin 54 along the longitudinal axis 535. The free end region 521 of the sliding piston 52 on the other hand is configured as yoke-shaped and embraces the web 541. For connecting the yoke 521 and the web 541*a* hinge bolt 55 is driven through both aforesaid components so that a connection in the manner of a Cardan joint is made.

The invention claimed is:

1. A linkage device for flap rudders for watercraft, comprising:

a first bearing housing including a sliding piston and a first sliding bearing; and a second bearing housing including a linkage pin and a second sliding bearing;

wherein the sliding piston and the linkage pin each have the same diameter, which diameter is determined with reference to loads acting on the sliding piston during operation, which loads acting on the sliding piston are larger than loads acting on the linkage in such that the diameter of the linkage pink is configured for the larger loads acting on the sliding piston;

wherein the first sliding bearing and the second sliding bearing each have the same diameter, the first and second sliding bearings respectively configured to receive the sliding piston and linkage in having the diameters as determined above;

wherein the first bearing housing and the second bearing housing each have the same diameter, each respectively configured to house the first and second sliding bearings configured as above;

wherein the first bearing housing and the second bearing housing each consist of the same material;

wherein the sliding piston and the linkage pin each consist of the same material; and wherein the first sliding bearing and the second sliding bearing each consist of the same material.

2. The linkage device according to claim 1, characterised in that the first or the second bearings consist of a non-metallic material of plastic or ceramic.

3. A flap rudder for watercraft, characterised in that the flap rudder comprises a linkage device according to claim 1.

4. The linkage device according to claim 1, wherein the first and the second bearings are bearing bushings.

5. The linkage device according to claim 1, wherein the first and the second bearings are solid friction bearings.

6. A linkage device kit for producing a linkage device for flap rudders for watercraft, characterised in that the kit comprises:

a cylindrical solid round steel body from which a sliding piston and linkage pin are made, wherein the sliding piston and the linkage pin each have the same diameter, which diameter is determined with reference to loads acting on the sliding piston during operation, which loads acting on the sliding piston are larger than loads acting on the linkage pin such that the diameter of the linkage pink is configured for the larger loads acting on the sliding piston;

a cylindrical hollow bearing body from which a first sliding bearing and a second sliding bearing are made, the cylindrical hollow bearing body for mounting at least one piece of the cylindrical solid round steel body, the first and second sliding bearings each having the same diameter and respectively configured to receive the sliding piston and linkage pin having the diameters as determined above;

a hollow tubular body from which a first bearing housing and a second bearing housing are made, the first and second bearing housings each having the same diameter and respectively configured to house the first and second sliding bearings configured as above;

a connection means for connecting two pieces of the cylindrical solid round steel body;

wherein the first bearing housing and the second bearing housing each consist of the same material;

wherein the sliding piston and the linkage pin each consist of the same material;

wherein the first sliding bearing and the second sliding bearing each consist of the same material;

wherein the bearing body comprises a solid lubricant; and wherein the outside diameter of a bearing body is slightly larger than the inside diameter of the hollow tubular body, wherein the bearing body can be fastened in the hollow tubular body by thermal expansion thereof, and that the outside diameter of the cylindrical solid round steel body corresponds to the inside diameter of the bearing body.

7. The kit according to claim 6, characterised in that the wall thickness of the hollow tubular body is greater than that of the bearing body.

8. A method for producing a linkage device for flap rudders for watercraft, comprising:

a first bearing housing in which a sliding piston and a first sliding bearing are arranged; and a second bearing housing in which a linkage pin and a second sliding bearing are arranged;

characterised in that for producing the sliding piston and the linkage pin, two pieces are separated from a cylindrical solid body, wherein the sliding piston and the linkage in each have the same diameter, which diameter is determined with reference to loads acting on the sliding piston during operation, which loads acting on the sliding piston are larger than loads acting on the linkage in such that the diameter of the linkage pink is configured for the larger loads acting on the sliding piston;

for producing the first and second sliding bearings at least one piece is separated from a cylindrical, hollow bearing body, the first and second sliding bearings having the same diameters respectively configured to receive the sliding piston and linkage pin having the diameters as determined above; and for producing the first and second bearing housings two pieces are separated from a tubular hollow body, the first and second bearing housings having the same diameters and respectively configured to house the first and second sliding bearings configured as above;

wherein the bearing body piece or the bearing body pieces are each inserted into a tubular hollow body piece and fastened there;

wherein the solid body pieces are each inserted into a bearing body piece or hollow body piece and thereby arranged in such a manner that in each case at least one end region of a solid body piece protrudes from that bearing body piece or hollow body piece into which it is inserted;

wherein the two solid body pieces are connected to one another in their at least one end regions;

wherein the first bearing housing and the second bearing housing each consist of the same material;

wherein the sliding piston and the linkage pin each consist of the same material;

wherein the first sliding bearing and the second sliding bearing each consist of the same material;

wherein respectively one recess for receiving a bearing body piece is produced in the inner surface of the hollow body pieces; and wherein the bearing body pieces are fastened in the hollow body pieces by thermal expansion thereof.

* * * * *

UNITED STATES PATENT AND TRADEMARK OFFICE

CERTIFICATE OF CORRECTION

PATENT NO. : 8,863,679 B2
APPLICATION NO. : 12/846090
DATED : October 21, 2014
INVENTOR(S) : Manfred Nagel et al.

It is certified that error appears in the above-identified patent and that said Letters Patent is hereby corrected as shown below:

In the Claims

In column 8, line 16 (claim 1), replace “linkage in” with -- linkage pin --.

In column 8, line 22 (claim 1), replace “linkage in” with -- linkage pin --.

In column 9, line 29 (claim 8), replace “linkage in” with -- linkage pin --.

In column 9, line 33 (claim 8), replace “linkage in” with -- linkage pin --.

Signed and Sealed this
Tenth Day of February, 2015

Michelle K. Lee

Michelle K. Lee
*Deputy Director of the United States Patent and Trademark Office*